United States Patent [19]

Mchuma

[11] 4,366,584

[45] Jan. 4, 1983

[54] BATHROOM APPLIANCES

[76] Inventor: Frank S. Mchuma, P.O. Box 738, Dar-Es-Salaam, United Rep. of Tanzania

[21] Appl. No.: 232,275

[22] Filed: Feb. 6, 1981

[30] Foreign Application Priority Data

Feb. 18, 1980 [GB] United Kingdom ..... 8005413

[51] Int. Cl.[3] ..... E03D 13/00

[52] U.S. Cl. ..... 4/307; 4/DIG. 2; 4/438; 4/441

[58] Field of Search ..... 4/300, 307, DIG. 2, 4/420, 424, 438, 441

[56] References Cited

U.S. PATENT DOCUMENTS

| | | | |
|---|---|---|---|
| 2,443,214 | 6/1948 | Williams | 4/DIG. 2 |
| 2,552,546 | 5/1951 | Fergusson | 4/DIG. 2 |
| 2,725,575 | 12/1955 | Colonna | 4/DIG. 2 |
| 2,750,599 | 6/1956 | Colonna | 4/DIG. 2 |
| 2,826,762 | 3/1958 | Colonna | 4/DIG. 2 |
| 2,879,519 | 3/1959 | Mueller | 4/DIG. 2 |
| 3,829,906 | 8/1974 | McPhee | 4/DIG. 2 |
| 4,045,827 | 9/1977 | Morris et al. | 4/DIG. 2 |

FOREIGN PATENT DOCUMENTS

| | | | |
|---|---|---|---|
| 840528 | 7/1952 | Fed. Rep. of Germany | 4/DIG. 2 |
| 1352 | of 1877 | United Kingdom | 4/307 |

*Primary Examiner*—Henry K. Artis

*Attorney, Agent, or Firm*—Allison C. Collard; Thomas M. Galgano

[57] ABSTRACT

In order to save space, a bathroom appliance such as a lavatory pan, urinal, basin or bidet is mounted to turn about a pivot axis between an operative position in which the appliance is accessible for its normal usage and an inoperative position in which the appliance is retracted into a cavity within or behind the structure, e.g. wall or floor, on which the appliance is pivotally mounted. The water inlet and waste outlet to and from said appliance are connected thereto by water tight joints which each include two parts relatively rotatable about the said pivot axis e.g. rotary ring joints.

8 Claims, 12 Drawing Figures

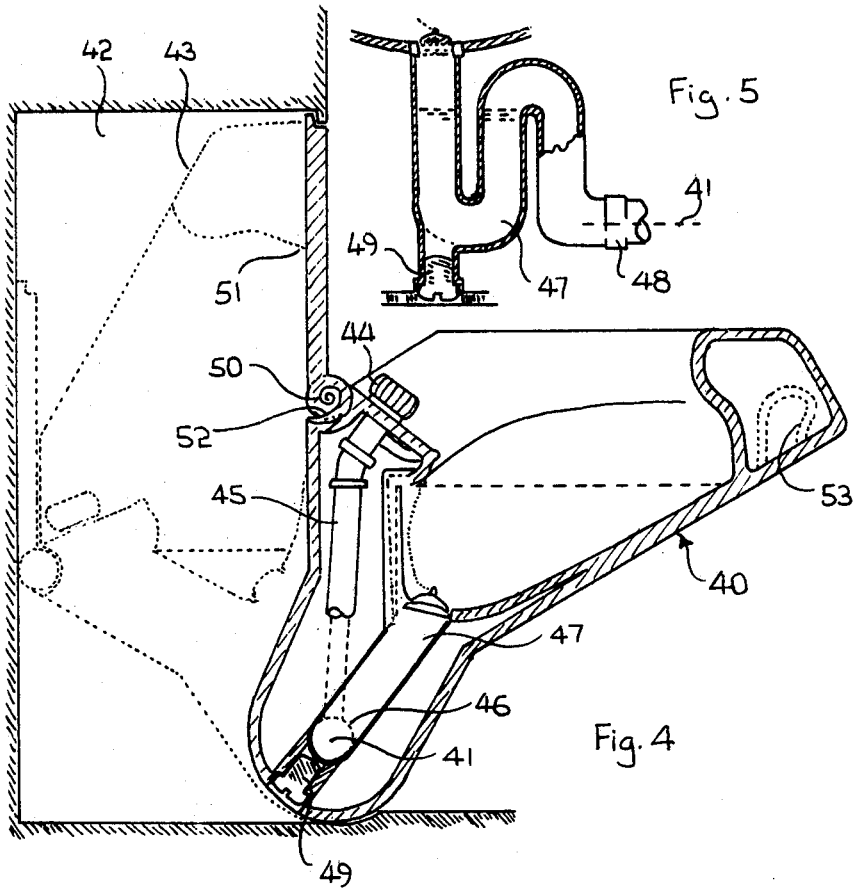
Fig. 5
Fig. 4
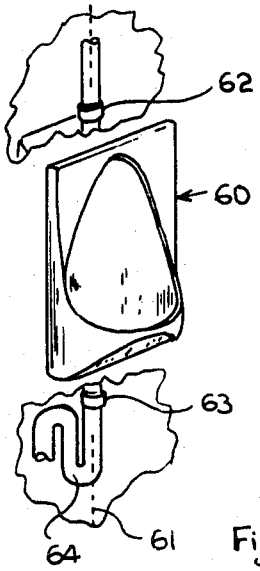
Fig. 6
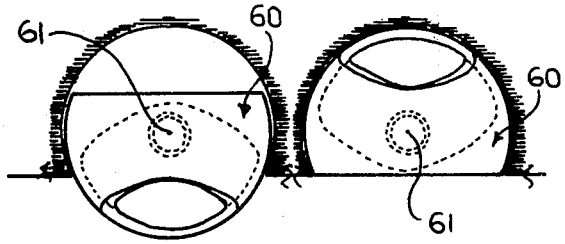
Fig. 7a
Fig. 7b.

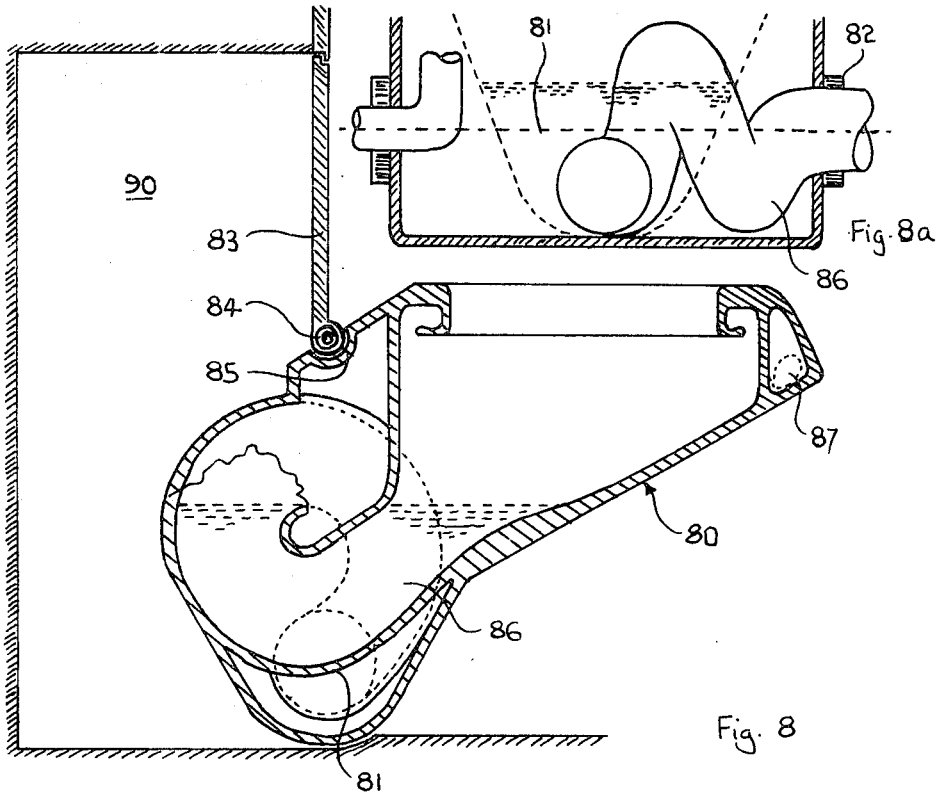
Fig. 8a
Fig. 8
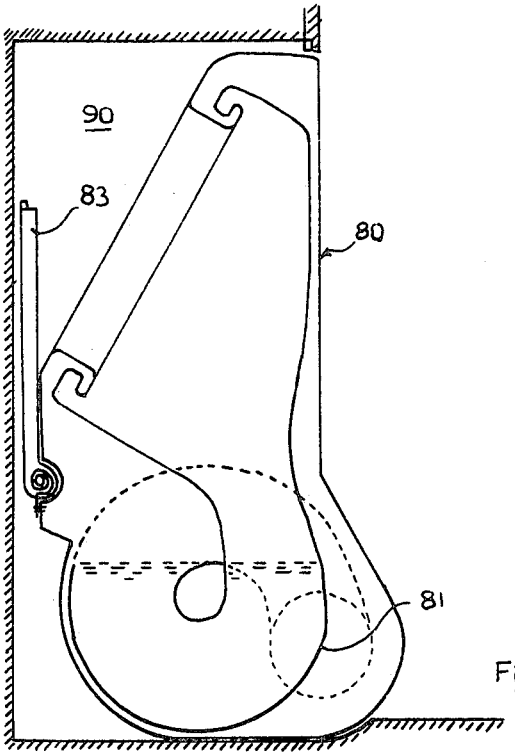
Fig. 9

BATHROOM APPLIANCES

FIELD OF THE INVENTION

This invention relates to bathroom type appliances, which term as used herein is intended to include all bathroom furniture having a clean water inlet and a waste outlet connected thereto, such as lavatory pans, urinals, bidets, basins, drinking fountains, sinks and baths, whether or not any one or more of such items of furniture are fitted in a room actually designated as a bathroom.

BACKGROUND

Conventional bathroom appliances are normally permanently fitted in exposed static positions in which they are open to dust and misuse. In addition, the appliances occupy considerable space, which is wasted except when the appliances are in use. Even in compact bathrooms, this wasted space is increased by the requirement to provide reasonable access to the appliances. Thus, unlike conventional free-standing furniture, which can be moved to create free space if necessary, static bathroom appliances necessarily occupy considerable space which is redundant except during relatively short periods of use of the appliances. This is especially disadvantageous in a necessarily confined or congested environment, such as in boats, ships, railcars, caravans or aircraft.

OBJECT OF THE INVENTION

It is a prime object of the present invention to minimise or overcome the above-described problems created by permanently fixed static bathroom appliances.

THE INVENTION

According to the invention, there is provided a bathroom type appliance mounted to turn about a pivot axis between an operative position in which the appliance is accessible for its normal usage and an inoperative position in which the appliance is retracted into a cavity within or behind the structure on which the appliance is pivotally mounted, wherein the water inlet and waste outlet to and from said appliance are connected thereto by water tight joints which each include two parts relatively rotatable about the said pivot axis.

The said structure may be a wall or floor, more usually the former, and the said pivot axis may be horizontal or vertical (or any other inclined orientation in a vertical plane) in the case of a wall structure, or may have any selected horizontal orientation in the case of a floor structure.

FURTHER FEATURES OF THE INVENTION

In the preferred form, the said water tight joints take the form of opposed ring joints spaced along the pivot axis to opposite sides (or top and bottom) of the appliance, one joint for clean water entry and one joint for waste exit. The said ring joints may be incorporated in opposed mounting hubs by which the appliance is pivotally mounted on its supporting structure or may be positioned just outside said mounting hubs relative to the appliance.

A water trap may be provided, either on the appliance side or on the remote side of the waste outlet joint.

The back or other part of the appliance exposed when the appliance is retracted will conveniently be surface finished to blend with the structure to which the appliance is fitted, and may carry supplementary devices such as a mirror, towel rail or the like, as well as a handle facilitating movement of the appliance when said appliance is to be moved manually.

In order to cover any part of the cavity left open when the appliance is moved to its operative position, a panel may be provided which is also movable between two positions, namely an operative cavity closing position (in which it preferably lies flush with the structure surface) when the appliance is in its operative position and a non-operative retracted position when the appliance is retracted. This screening panel is preferably mounted to move automatically with the appliance; for example said panel may be mounted to turn under spring bias about a secondary pivot axis parallel to the main pivot axis of the appliance. The screening panel may carry certain components of the appliance, such as taps, for example, water supply to the tap being effected through the rotary supply joint on the main pivot axis and a supplementary rotary joint on the secondary pivot axis.

BRIEF DESCRIPTION OF DRAWINGS

In the accompanying drawings:

FIG. 4 is a section through the bidet in a plane transverse to the main pivot axis;

FIG. 5 shows a detail of the bidet in longitudinal section;

FIG. 6 is a perspective view of a urinal with top and bottom pivotal mountings;

FIGS. 7*a* and 7*b* show the operative and retracted positions of the urinal in plan view;

FIG. 8 is a section through a lavatory pan, in its operative position, in a plane transverse to the main pivot axis;

FIG. 8*a* shows a detail of FIG. 8 in longitudinal section;

FIG. 9 shows the lavatory pan of FIG. 8 in its retracted position;

DESCRIPTION OF EMBODIMENTS

Figure 1:
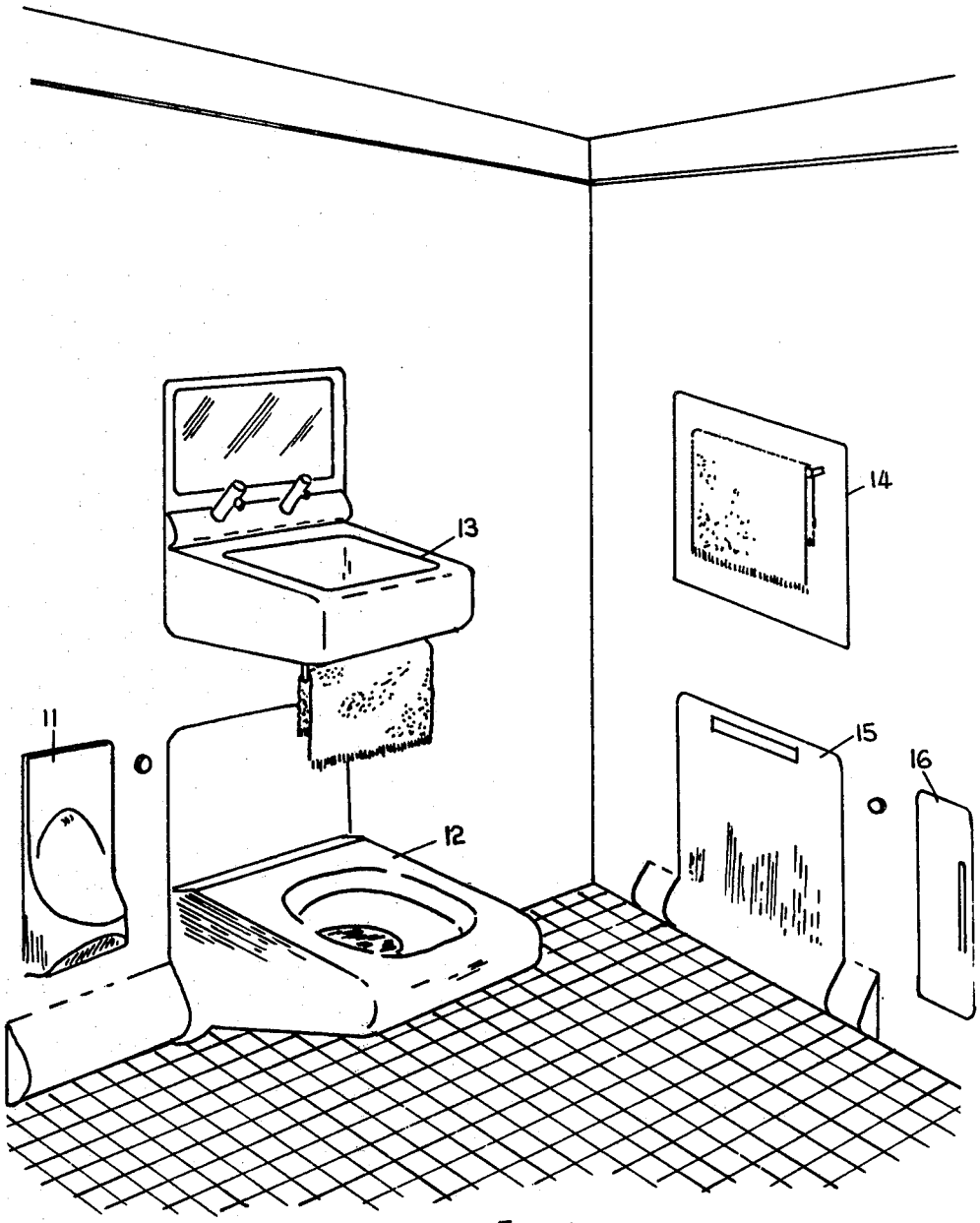
FIG. 1 is a perspective view of a bathroom fitted with appliances in accordance with the invention.

FIG. 1 shows a bathroom having various water connected appliances fitted therein. All these appliances are retractable into the walls on which said appliances are mounted. In the drawing, a urinal 11, a lavatory pan 12 and a basin 13 are shown in their operative positions. Closed appliances 14, 15 and 16 are also indicated. The mounting of the basin 13 above the pan 12 is to be noted. As both appliances will not be in use at the same time, only one or the other will be in its operative position at any one time. Both appliances are shown in their operative positions in the drawing, in order to indicate the wall and floor space which can be saved with retractable appliances in accordance with the invention.

Figure 2:
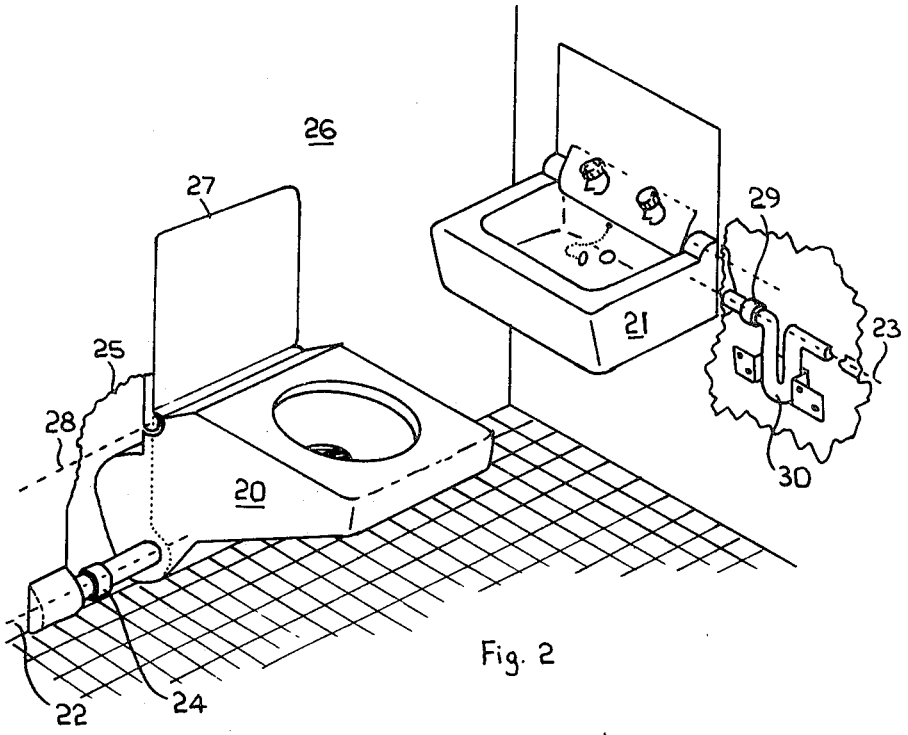
FIG. 2 is a perspective view of a section of a bathroom containing lavatory pan and basin.

FIG. 2 shows, in somewhat more detail, a lavatory pan 20 and a basin 21. The pan 20 has a main pivot axis 22, and the basin has a main pivot axis 23.

A clean water supply is connected to the pan 20 at a water tight rotary ring joint 24 located on the pivot axis 22. The pan 20 is retractable about the axis 22 into the space 25 within or behind the wall 26, and for covering the part of the wall opening which would be exposed when the pan is in the operative position shown, a screening panel 27 is mounted to turn about a secondary pivot axis 28. The panel 27 is automatically movable into its screening position when the appliance is pulled out, and is retracted into the space behind the wall when the appliance is retracted.

A waste outlet from the basin 21 is connected to a water tight rotary ring joint 29 on the main pivot axis 23. The remote side of the joint 29 connects with a U-trap 30 of conventional kind. A screening panel is not shown in the case of the basin 21.

Figure 3:
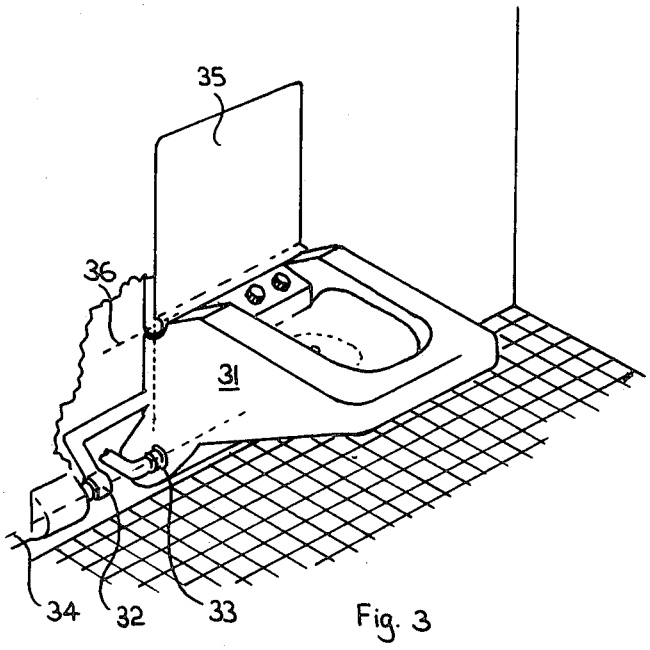
FIG. 3 is a perspective view of a bathroom section fitted with a bidet.

FIG. 3 illustrates a bidet 31 having hot and cold clean water supplies connected thereto by means of rotary joints 32 and 33 located on the main pivot axis 34. A screening panel 35 is mounted to turn about a secondary axis 36.

FIG. 4 is a sectional view showing a bidet mounting in more detail. The bidet 40 is pivotal about a main axis 41 for retraction into a wall space 42, wherein the retracted position of the bidet is shown in dotted outline 43. A clean water supply is fed to the pressure control tap 44 through a feed pipe 45 connected to a rotary inlet joint 46 on the main axis 41 to one side of the appliance. A waste outlet incorporating a U-trap 47 (see FIG. 5) is connected to an outlet joint 48 on the other side of the appliance. The plug 49 affords access to the U-trap 47 for maintenance. Mounted to turn about a secondary axis 50 is a screening panel 51. A spiral spring 52 urges the panel 51 into its screening position when the bidet 40 is pulled out from its retracted position by use of the hand grip 53. It is to be noted that as the U-trap 47 is positioned inside the rotary joint 48 to turn with the bidet 40, it is arranged to perform its proper function in all positions of the bidet throughout the range of movement thereof.

FIG. 6 shows a retractable urinal 60, mounted to turn about a vertical pivot axis 61. A clean water inlet is provided on the top through a rotary joint 62, and the waste outlet at the bottom connects through a rotary joint 63 to a U-trap 64 of conventional kind. FIGS. 7*a* and 7*b* indicate the urinal in its operative and retracted positions, respectively.

FIG. 8 is a transverse cross-sectional view through a lavatory pan 80 having a main pivot axis 81. The longitudinal cross-sectional detail of FIG. 8*a* shows the mounting hubs 82 by which the appliance is mounted to the supporting wall structure. Generally similar mounting hubs are employed to provide the pivotal supports for the appliances previously described. The rotary inlet and outlet joints to the appliance lie outside the mounting hubs 82, beyond the extent of FIG. 8*a*. FIG. 8 also shows a screening panel 83 associated with the pan 80, which panel 83 is urged by means of a spring 84 about a secondary axis 85. An important feature of the appliance lies in the convolute water trap 86 provided inside the waste outlet joint. This form of water trap 86 ensures a gentle but efficient discharge of waste when the lavatory is flushed, while efficiently sealing the outside plumbing and sewer drains from the interior atmosphere in all positions of the appliance in its range of pivotal movement. A hand grip is indicated at 87, while FIG. 9 shows the pan 80 in its retracted position within a cavity 90 in the wall structure.

Figure 10:
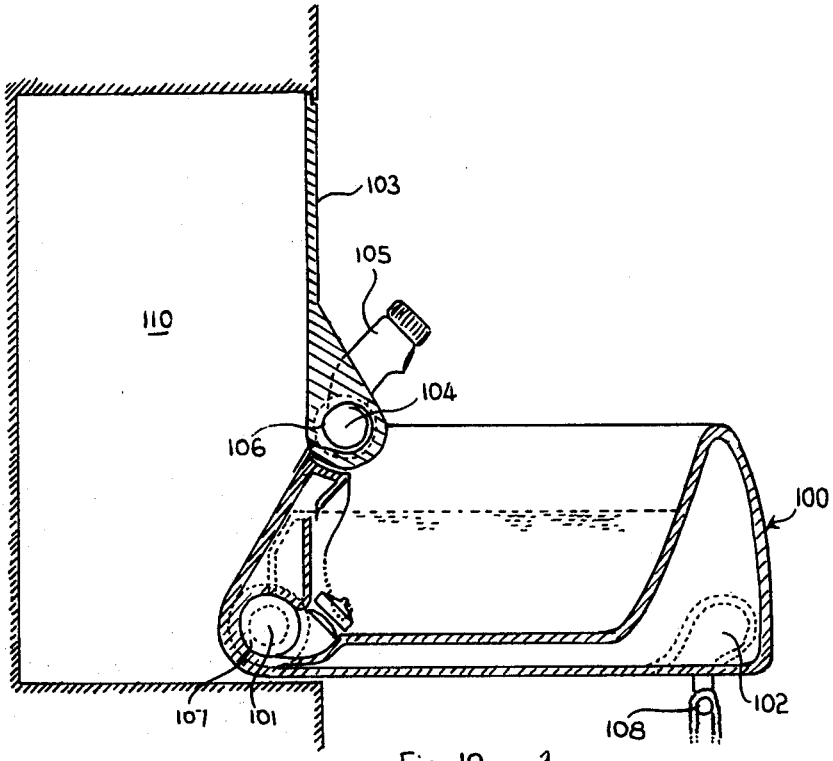
FIG. 10 is a section through a basin, in its operative position, in a plane transverse to the main pivot axis.
Figure 11:
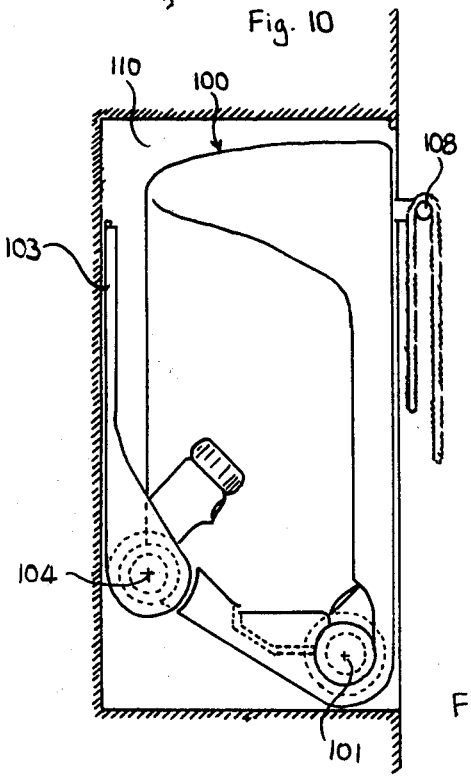
FIG. 11 shows the basin of FIG. 10 in its retracted position.

FIGS. 10 and 11 show a retractable wash basin 100 pivotable about a main axis 101 with the aid of a hand grip 102. A screening panel 103 is mounted to turn about a secondary axis 104. This appliance is of particular interest because the taps, of which one referenced 105 is visible in the drawings, are mounted on the panel 103. Clean water is connected to the tap 105 through a supplementary water tight rotary joint 106 located on the secondary axis 104. A feed pipe (not shown) connects the joint 106 to the primary inlet joint 107 on the main axis 101. Assuming that the tap 105 is for cold water, there will be similar primary and supplementary joints and a connecting feed pipe for the hot water tap. Both primary inlet joints are located on the main axis 101 to one side of the appliance. The waste outlet on the other side of the appliance is not visible in the drawings. Reference 108 denotes a towel rail carried on the underside of the basin 100. A towel carried thereon is also available for use when the basin is retracted into the wall cavity 110, as shown in FIG. 11. The previously described appliances may also carry supplementary bathroom equipment such as mirrors or the like on the back or undersurface thereof, exposed to the interior of the bathroom when the appliance is in its retracted position. Likewise, the screening panel may carry similar supplementary devices, such as a toilet paper holder, exposed when the appliance is operative, in addition to its possible use for supporting taps or other components of the actual appliance.

The following general considerations apply in relation to the above-described appliances. All the appliances are designed to operate by gravitational drainage, and are provided with the necessary overflow drainage, which is designed to be available at any position in its path of movement about the main pivot axis. Beyond the rotary inlet and outlet joints to the outside of the appliance, conventional water supply means, drainage and intermediate plumbing is applicable. When any appliance components or supplementary devices are carried by a screening panel pivotal about a secondary axis, these will be arranged to move in paths clear of the appliance and out of contact with any water therein, for example to avoid risk of back siphoning in the case of taps. All parts of the clean water supply system (hot and cold) will be protected against contamination from the appliance in all positions in the range of movement. The rotary joints will preferably be concealed within covers which are removed to allow the joints to be examined and maintained. The bodies of the appliances will be dimensioned taking into account their retractability, especially to minimise the depth of cavity necessary to accommodate the appliance, while preserving the visual finishing requirements for such appliances having regard to comfort and hygiene. The appliances may be manufactured and distributed in parts for assembly on site, or may be produced and distributed as complete modular units ready for fitting to a suitable structural cavity. In either case, the appliance will have due strength to support itself and any expected loads during use, whilst being of minimum weight to facilitate its movement. Having regard to this requirement, an appliance can be produced by moulding or casting, with hollow or solid section walls, and may incorporate reinforcing fibers, all depending on the nature of the material of which the body of the appliance is made.

The appliances may be associated with various supplementary mechanisms. For example, the lavatory pan can be adapted for automatic flushing when the pan is retracted, possibly dependent on failure to use a normal manual flushing mechanism. Safety locks can be added, or the appliances can be associated with driving mechanisms for automatically withdrawing and retracting the appliances in dependence on the approach and departure of a user. For public bathrooms and cloakrooms, a coin release mechanism can be provided, insertion of the coin permitting manual withdrawal of the appliance or initiating operation of a driving mechanism. Combinations of these and other supplementary mechanisms can readily be incorporated according to the requirements of users, without affecting the basic appliance retraction mechanism hereinbefore described.

I claim:

1. A bathroom type appliance comprising:

a supporting structure defining a cavity;

an appliance mounted on the supporting structure by pivotal mounting means defining a pivot axis about which the appliance can be turned between an operative position in which the appliance is accessible for normal usage and an inoperative position in which the appliance is retracted into said cavity;

a water inlet to and a waste outlet from said appliance;

respective watertight joints connecting the water inlet and waste outlet to said appliance, each joint including two parts relatively rotatable about said pivot axis;

a screen for covering the cavity when the appliance is in its inoperative position;

an auxiliary screening panel for covering any part of the cavity which is left open when the appliance is in the operative position;

mounting means permitting movement of said auxiliary screening panel; and coupling means whereby the auxiliary screening panel is automatically moved between an operative, cavity closing position and a non-operative retracted position when the appliance is moved between its operative and non-operative positions.

2. An appliance as claimed in claim 1 in which the said structure comprises a wall.

3. An appliance as claimed in claim 1 in which the said water tight joints comprise opposed ring joints spaced along the pivot axis to opposite sides (or top and bottom) of the appliance, one joint for clean water entry and one joint for waste exit.

4. An appliance as claimed in claim 3 in which the said mounting means comprise opposed mounting hubs, the said ring joints being incorporated in the mounting hubs.

5. An appliance as claimed in claim 3 in which the said mounting means comprise opposed mounting hubs, the said ring joints being positioned just outside said mounting hubs relative to the appliance.

6. An appliance as claimed in claim 1 further comprising a water trap, either on the appliance side or on the remote side of the waste outlet joint.

7. An appliance as claimed in claim 1 in which said mounting means for the screening panel define a secondary pivot axis parallel to the main pivot axis of the appliance, the mounting means including spring biasing means adapted to cause appropriate movement of the screening panel on movement of the appliance.

8. An appliance according to claim 7 in which the screening panel carries a tap, water supply to the tap being effected through the rotary supply joint on the main pivot axis and a supplementary rotary joint on the secondary pivot axis.

* * * * *